US006619276B1

(12) United States Patent
Miller et al.

(10) Patent No.: US 6,619,276 B1
(45) Date of Patent: Sep. 16, 2003

(54) POSITIVE CRANKCASE VENTILATION ORIFICE MUFFLER

(75) Inventors: Alan S. Miller, Farmington Hills, MI (US); David Thomas Hanner, Milford, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/230,017

(22) Filed: Aug. 28, 2002

(51) Int. Cl.[7] ..... F02M 25/06
(52) U.S. Cl. ..... 123/572; 181/204
(58) Field of Search ..... 123/572, 573, 123/574, 41.86; 181/204

(56) References Cited

U.S. PATENT DOCUMENTS 5,107,800 A * 4/1992 Araki et al. ..... 123/184.57
5,125,940 A * 6/1992 Stanhope et al. ..... 123/198 E
5,479,907 A * 1/1996 Walker, Jr. ..... 123/573
6,178,939 B1 * 1/2001 Powell ..... 123/184.21
6,199,543 B1 * 3/2001 Bedkowski ..... 123/572

* cited by examiner

*Primary Examiner*—Marguerite McMahon
(74) *Attorney, Agent, or Firm*—Leslie C. Hodges

(57) ABSTRACT

An orifice muffler is designed to minimize the sound pressure level of noise emanating from control orifices in the positive crankcase ventilation (PCV) system of an automotive vehicle engine. The muffler is formed as an elongated tube having imperforate sidewalls and inlet and outlet end walls. The outlet end wall has a single orifice sized to provide a control exhaust gas flow thorough the muffler while the inlet end wall has at least two orifices of differing sizes. The inlet orifices are operative to pass the controlled gas flow and to create destructive wave interference between the flow streams thorough the muffler to minimize noise caused by turbulent flow. Various optional features of the muffler construction are also disclosed.

13 Claims, 2 Drawing Sheets

POSITIVE CRANKCASE VENTILATION ORIFICE MUFFLER

TECHNICAL FIELD

This invention relates to positive crankcase ventilation for automotive vehicle engines and, more particularly, to a combination flow control orifice and muffler for reducing noise emitted from the PCV orifice and system.

BACKGROUND OF THE INVENTION

Positive crankcase ventilation (PCV) systems have been used for many years to reduce emission of contaminants by recirculating blowby gases and crankcase vapors into the engine cylinders for burning. This is commonly accomplished by drawing the crankcase vapors through a liquid separator and conducting the resulting vapors and contaminants into the air intake or the intake manifold where it is drawn into the cylinders by intake system or intake manifold vacuum. If the crankcase vapors are drawn into an intake manifold, a PCV valve is generally required to control the amount of PCV flow because the manifold vacuum varies greatly and generally inversely to the amount of crankcase vapors which it is necessary to have recirculated. However, where the vapors are recirculated into the air intake system, it has been generally satisfactory to control the crankcase vapor flow by means of an orifice.

In the development of a new engine design, it was desired to simplify the PCV system and replace the usual PCV valve by utilizing a single orifice at the outlet from the cam cover, which encloses a volume connecting with the engine crankcase, and a fitting at an inlet to the intake manifold, the orifice and the fitting being connected by a fluid-conducting hose. It was found, however, that when the engine was operated at idle, a "vacuum leak" like hiss noise was radiated from the orifice. The noise level of the orifice and PCV system exceeded the background noise level of the engine in the idle condition, where intake manifold vacuum is high, and was deemed unacceptable. A modified noise-reducing PCV orifice was accordingly desired.

SUMMARY OF THE INVENTION

The present invention provides a noise-reducing positive crankcase ventilation (PCV) orifice, called hereinafter an orifice muffler. As developed, the orifice muffler substantially reduced the objectionable noise levels in the frequency range above 2500 Hz, which were responsible for the objectionable noise transmissions in the original design.

The orifice muffler of the invention comprises an elongated tube with imperforate side walls and inlet and outlet end walls. The outlet end wall is provided with a single orifice while the inlet end wall includes at least two orifices of differing sizes. The dual dissimilar inlet orifices are operative to pass the controlled gas flow and to create destructive wave interference between the flow streams through the muffler to minimize the noise caused by turbulent air flow through the muffler.

Preferably, the tube is made of steel, or a material having heat transfer characteristics near that of steel, so that the tube heats up quickly during operation and freezing of moisture in the orifices is thereby avoided. The wall thickness of the steel tube is made sufficiently thick to minimize radiated noise from the muffler. Preferably, the length of the tube ranges between about 30 and 40 millimeters to attenuate relatively high frequency noise, and the expansion ratio of the inlet orifice areas to the cross-sectional area of the tube is at least 10 to 1 to maximize attenuation of the turbulent flow noise.

The tube may be made as a single element but is more easily formed as separate inlet and outlet steel stampings having mating flanges that are coated with a corrosion preventive and fixed together, such as by rolling or crimping, to form the muffler assembly.

As installed in a PCV system, the orifice muffler reduces the noise level of PCV flow into the intake manifold during engine idle and allows the use of the orifice in place of a PCV valve as is usually required for control of PCV flow directly into an engine intake manifold.

These and other features and advantages of the invention will be more fully understood from the following description of certain specific embodiments of the invention taken together with the accompanying drawings.

DESCRIPTION OF THE PREFERRED EMBODIMENT

Figure 1:
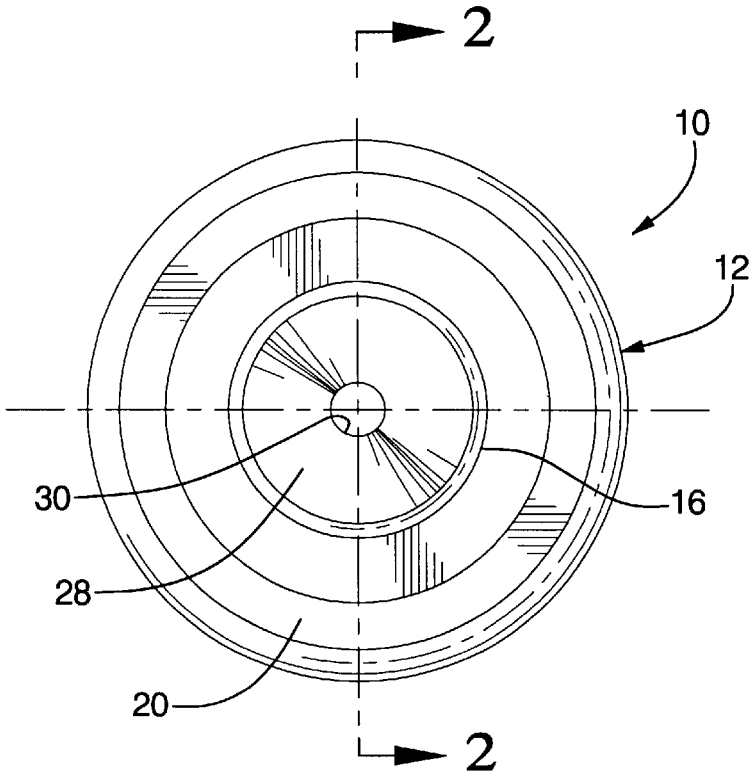
FIG. 1 is an outlet end view of an exemplary embodiment of PCV orifice muffler formed according to the invention.
Figure 2:
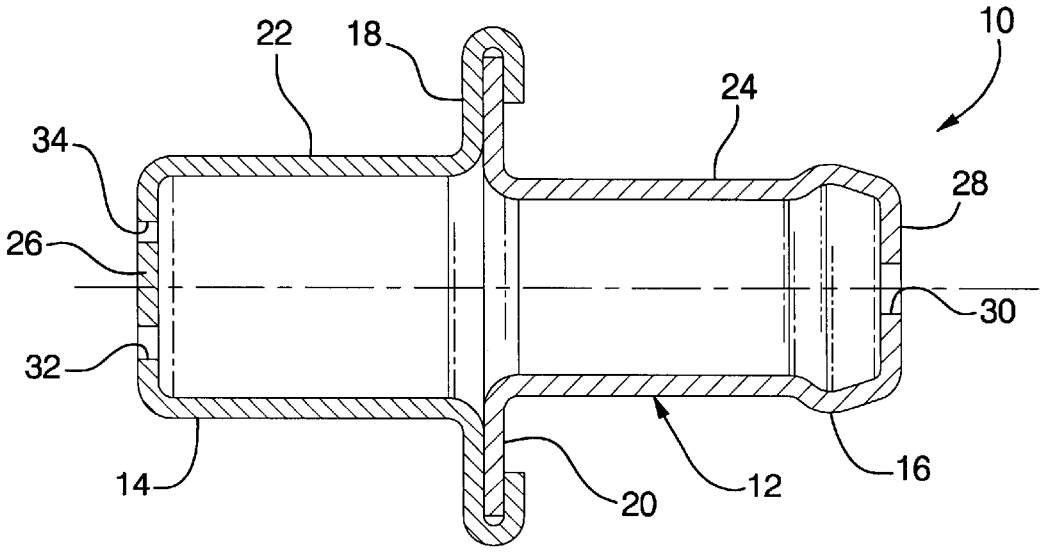
FIG. 2 is a cross-sectional view of the muffler taken along the line 2—2 of FIG. 1.

Referring first to FIGS. 1 and 2 of the drawings in detail, numeral 10 generally indicates an exemplary embodiment of PCV orifice muffler formed according to the invention. Muffler 10 includes a body in the form of an elongated tube 12 which is preferably formed of steel or a material having similar heat transfer characteristics. The tube is preferably formed with separate inlet and outlet ends 14, 16, respectively, which are coated with a corrosion preventive and joined by inlet and outlet flanges 18, 20, one of which is rolled or crimped over the other to provide an essentially leak-proof joint. The tube 12 is generally cylindrical having imperforate side walls 22, 24 and inlet and outlet end walls 26, 28, respectively.

The outlet end wall includes a single orifice 30 sized to assist in providing controlled gas flow through the muffler. The inlet end wall includes at least two orifices of differing sizes that are operative to pass the controlled gas flow and to create destructive wave interference between flow streams through the muffler to minimize noise caused by turbulent fluid flow in the tube. In the present instance, two orifices are used which differ only slightly in diameter and have area ratios generally in the neighborhood of 4 to 3, their total area approaching one-fourth of the total area of the outlet orifice 30. The difference in the inlet orifice areas is designed to create destructive wave interferences between the flow streams through the muffler to help minimize noise caused by turbulent flow passing through the tube 12.

In the orifice muffler 10, the size of the tube 12 is relatively small, having a length of between 30 and 40 millimeters and a maximum internal diameter ranging from between about 7 and 11 millimeters. The expansion ratio of the combined inlet orifice areas to the cross-sectional area of the adjacent portion of the tube is at least 10/1 to maximize attenuation of the turbulent flow noise. The wall thickness of the preferred steel material is about 1 millimeter, which is sufficiently thick to avoid substantial radiation of noise developed within the tube muffler.

It should be recognized that the tube could be made of materials other than the steel material illustrated although the considerations of noise radiation and freezing of the orifices would need to be addressed. Also, for application in engines with differing blowby flow requirements, the size, shape and general configuration of the muffler may have to be modified in accordance with guidelines indicated herein. The degree of departure or modification required would need to be determined by testing, as the development of the present muffler was proven by testing of various designs prior to determining the suitability of the design illustrated and described herein.

Figure 3:
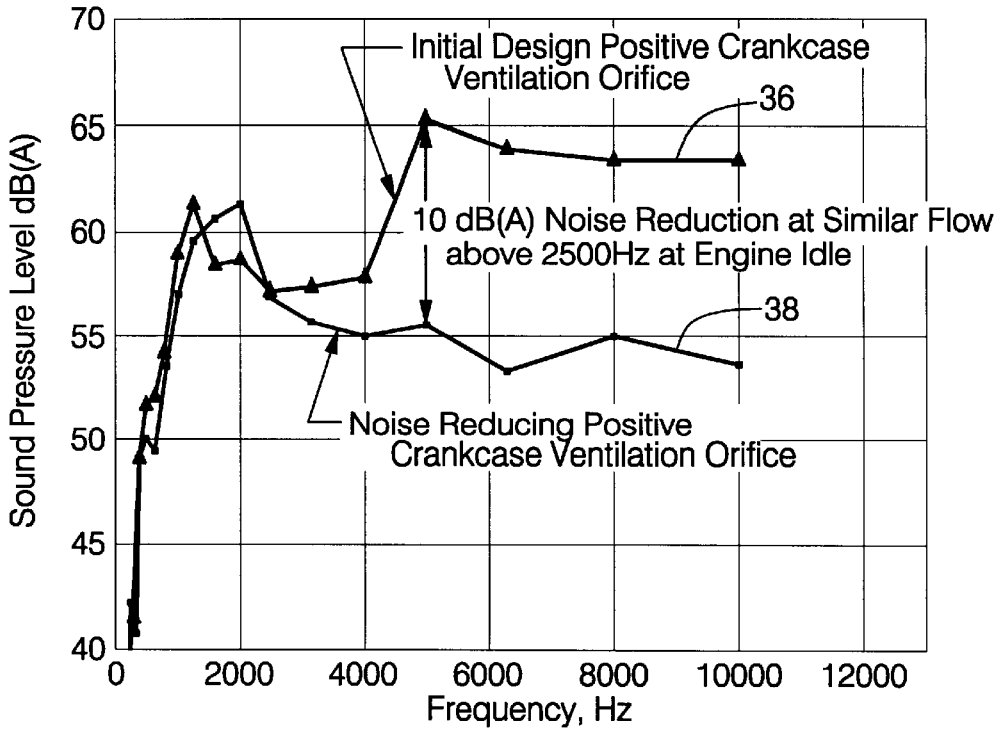
FIG. 3 is a graphical illustration comparing sound pressure levels vs. frequency for the original orifice to those of the embodiment of FIGS. 1 and 2.

Referring now to FIG. 3, there is a diagram indicating sound pressure levels in decibels [dB(A)] vs. frequency in hertz (Hz). In the figure, line 36 indicates the sound levels of the original orifice designed for the engine which, it is noted, increased substantially above about 2500 Hz. Line 38 illustrates the lower noise levels of the orifice muffler of the invention which, it is noted, are substantially reduced, and generally level out at frequencies above 2500 Hz. The reduction in noise output obtained by the orifice muffler of the invention is in the range of 10 dB(A) of sound pressure making for a significantly quieter flow noise emanating from the orifice muffler of the invention compared to the original orifice.

Figure 4:
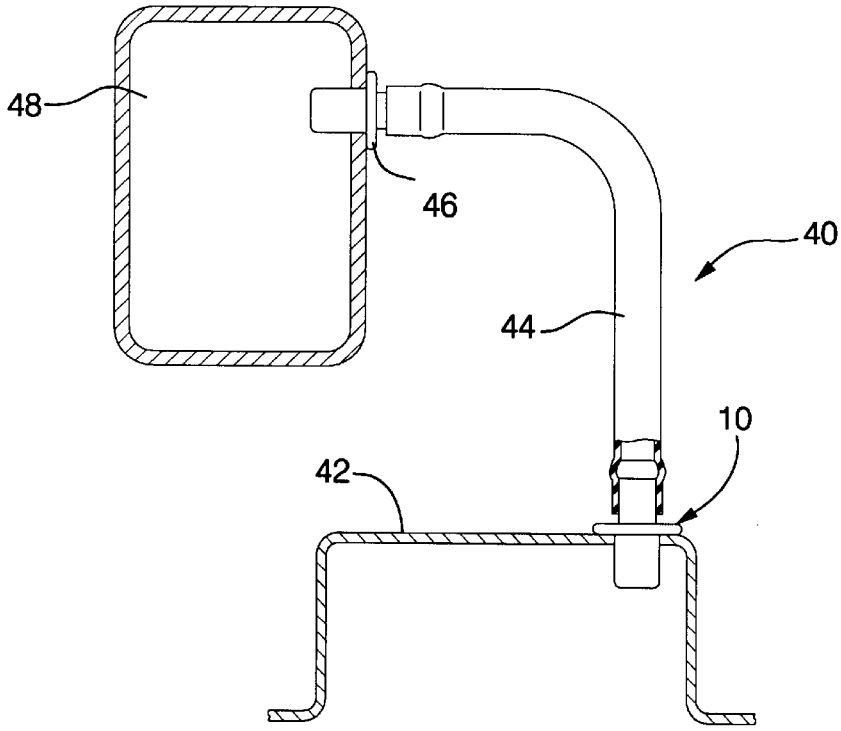
FIG. 4 is a schematic diagram of the orifice muffler installed in an engine PCV system.

FIG. 4 schematically illustrates application of the PCV orifice muffler 10 in an engine PCV system 40. The orifice muffler 10 is mounted in an oil separation portion 42 of a cylinder head cam cover. The orifice 10 connects directly with a PCV hose 44 that leads to a fitting 46 on the engine intake manifold 48 for recirculating blowby and crankcase vapors into the engine cylinders, not shown.

In operation, PCV flow is drawn from the cam cover into the engine manifold by the negative pressure in the manifold. At idle, when manifold vacuum is greatest, the resulting PCV flow is controlled and quieted by the orifice muffler 10 to operate with a satisfactory noise level without the need for a PCV valve.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A PCV orifice muffler comprising:

an elongated tube having imperforate side walls and inlet and outlet end walls;

the outlet end wall having a single orifice sized to provide a controlled exhaust gas flow through the muffler; and the inlet end wall having at least two orifices of differing sizes operative to pass the controlled gas flow and to create destructive wave interference between flow streams through the muffler to minimize noise caused by turbulent flow.

2. A PCV orifice muffler as in claim 1 wherein the tube has heat transfer characteristics near that of steel to minimize freezing of moisture in the orifices during engine warm-up in cold temperatures.

3. A PCV orifice muffler as in claim 1 wherein the tube has a wall thickness selected to minimize radiated noise caused by turbulent flow passing through fixed orifices.

4. A PCV orifice muffler as in claim 1 wherein the tube length is between about 30 and 40 mm to attenuate relatively high frequency noise.

5. A PCV orifice muffler as in claim 1 wherein the expansion ratio of the inlet orifice areas to the cross-sectional area of the tube is at least 10/1 to maximize attenuation of the turbulent flow noise.

6. A PCV orifice muffler as in claim 1 wherein the tube is formed of separate inlet and outlet steel stampings having mating flanges that are fixed together to form a muffler assembly.

7. A PCV system for an engine having a passage member connected to conduct crankcase vapors directly to an intake manifold of the engine and a PCV orifice muffler connected with the passage member, the orifice muffler comprising:

an elongated tube having imperforate side walls and inlet and outlet end walls;

the outlet end wall having a single orifice sized to provide a controlled exhaust gas flow through the muffler; and the inlet end wall having at least two orifices of differing sizes operative to pass the controlled gas flow and to create destructive wave interference between flow streams through the muffler to minimize noise caused by turbulent flow.

8. A PCV system as in claim 7 wherein the passage member is a hose and the orifice muffler acts as a fitting for connecting the hose with a crankcase vapor containing portion of the engine.

9. A PCV system as in claim 7 wherein the tube has heat transfer characteristics near that of steel to minimize freezing of moisture in the orifices during engine warm-up in cold temperatures.

10. A PCV system as in claim 7 wherein the tube has a wall thickness selected to minimize radiated noise caused by turbulent flow passing through fixed orifices.

11. A PCV system as in claim 7 wherein the tube length is between about 30 and 40 mm to attenuate relatively high frequency noise.

12. A PCV system as in claim 7 wherein the expansion ratio of the inlet orifice areas to the cross-sectional area of the tube is at least 10/1 to maximize attenuation of the turbulent flow noise.

13. A PCV system as in claim 7 wherein the tube is formed of separate inlet and outlet steel stampings having mating flanges that are fixed together to form a muffler assembly.

* * * * *